United States Patent [19]

Miller

[11] 4,283,056

[45] Aug. 11, 1981

[54] PROCESS FOR SIMULATING GAME OF GOLF

[76] Inventor: Franklin C. Miller, 909 Volante Dr., Arcadia, Calif. 91006

[21] Appl. No.: 106,889

[22] Filed: Dec. 27, 1979

Related U.S. Application Data

[62] Division of Ser. No. 927,291, Jul. 24, 1978, Pat. No. 4,192,510.

[51] Int. Cl.[3] ..... A63B 69/36

[52] U.S. Cl. ..... 273/176 A

[58] Field of Search ..... 273/32 H, 32 R, 176 L, 273/176 FA, 176 A, 245, 85 G, DIG. 28, 35 B, 176 R

[56] References Cited

U.S. PATENT DOCUMENTS

| | | | |
|---|---|---|---|
| 3,464,703 | 9/1969 | Vallas | 273/176 A |
| 3,649,027 | 3/1972 | Vallas | 273/176 A |
| 3,685,832 | 8/1972 | Johnson | 273/176 A |
| 4,192,510 | 3/1980 | Miller | 273/176 A |

*Primary Examiner*—George J. Marlo
*Attorney, Agent, or Firm*—Wm. Jacquet Gribble

[57] ABSTRACT

The process utilizes a conventional golf practice driving range with added greens with flags for approach shots, the conventional practice putting greens and a computer with a viewing screen. The computer is programmable, as by a cassette tape, to show in sequence layout and data on each of the eighteen holes of a selected classical golf course. The actual drives and approach shots are "played" on the practice driving range and are added to the computer information on the screen to show ball placement on the screened course. A golfer can play realistically any of the great courses of the world and measure his game against the par for those courses by the process, completing putting out for a final score on adjacent practice greens. A putting phase for each hole is preferably done after the drive and approach shots are made for all eighteen holes, or each nine holes, but may be done on the practice green after the drive and approach shots for each hole.

3 Claims, 4 Drawing Figures

PROCESS FOR SIMULATING GAME OF GOLF

RELATED APPLICATIONS

This application is a division of my copending application Ser. No. 927,291, filed July 24, 1978 and titled "PROCESS AND APPARATUS FOR SIMULATING GAME OF GOLF", now U.S. Pat. No. 4,192,510.

BACKGROUND OF THE INVENTION

Access to actual eighteen hole golf courses is becoming limited by the popularity of the game. Access to famous courses made even more popular by TV broadcasts, and limited in many cases to members only, precludes average golfers from experiencing the famous courses of the world. Also, the average course is long enough to require expensive riding carts for all but the healthiest. However, practice driving ranges and putting greens exist in many areas, with the ranges marked in yards or meters such that the practicing golfer has an accurate measure of the distance his ball has been driven from the practice tee. The associated practice putting greens are of various contours, lengths and cup placement to test putting skills of golfers. The simple addition to the practice driving range of several "greens" indicated by flags located varying distances from the driving range tee area supplies the third component of the average golf course. The further addition of a simple computer of the game type with a video screen adapted to receive a plug-in program which programs the screen image to show various golf holes of a popular or famous golf course gives the practicing golfer right before him all of the elements necessary to measure his skills against a particular course for all eighteen holes.

SUMMARY OF THE INVENTION

The invention contemplates a process for a simulated game of golf that employs a conventional golf practice range with a measured driving range, approach greens, and practice putting greens, and a game-type computer having a readout screen programmable with a golf course layout, and player-accessible controls for marking ball position on the screen, in which the steps of the process include programming the computer to image successively the entire layout of each hole of a given golf course, driving a ball on the practice driving range and positioning an image "ball" on the screen in accordance with the distance of the driven ball. If a long hole, a second ball is then struck on the driving range and the image ball on the screen hole layout is placed in accordance with the computer-calculated accumulated distance from the practice tee of the first and second struck balls. Depending on hole length a second or a third ball may be struck toward an approach green on the driving range selected in accordance with the distance from the player of the selected approach green as indicated by the position of the image ball with respect to the image cup. Once the player has hit his ball to the green or adjacent the green, the score card is marked with the ball position for the hole. Another ball is stroked on the putting practice green until the ball is downed in the green cup. The steps of the process are then repeated for each screen layout with which the computer is programmed.

The inventive apparatus to implement the simulated golf game includes the conventional golf practice driving range and associated practice putting greens combined with approach greens of different distances from the range tees, a computer and a computer program that makes visible on the computer readout screen a golf course layout. Player accessible controls on the computer are used to indicate the ball position on the screened layout and to change the screened layout.

It has been found that the conventional computer with a viewing screen, such as a "12K" computer by Bally Arcade, for one, may be programmed in accordance with the invention to indicate a particular golf course hole layout. Such computers also have player accessible controls for positioning an indicator dot or circle or lozenge on the screen layout. The process may therefore be easily implemented by the simple supply at the driving range tee area of computers, preferably secured detachably to permanent posts and associated each with a particular player zone such that it is handy for a golfer on the driving range. Thus, for a small additional investment a golf driving range becomes more desirable to a practicing golfer because the golfer can simulate realistically an eighteen hole game without having to gain access to a restricted golf course or hire a golf cart for transport.

These and other advantages of the invention are apparent from the following detailed description and drawing.

DESCRIPTION OF THE PREFERRED EMBODIMENTS

Figures 1, 3:
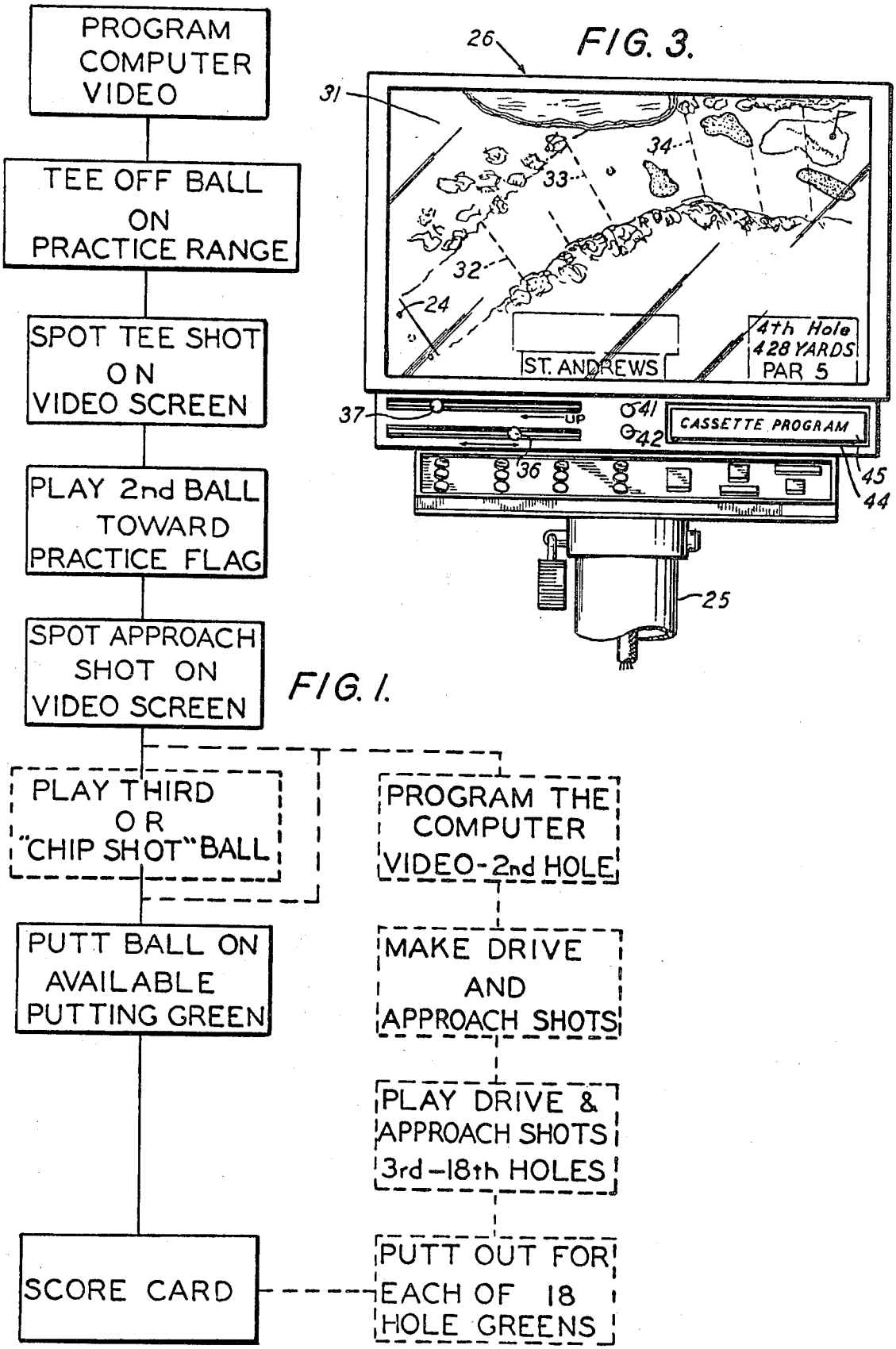
FIG. 1 is a block diagram of the process of the invention, with alternate steps being shown in broken lines.
FIG. 3 is a schematic view of a programmed computer showing a particular golf course hole layout.

In the block diagram of FIG. 1 each step of the process is set forth in a separate block. The top block refers to inserting the program of the selected course into the computer. When the screen shows the first hole layout, which is presumed to be a par 4 or 5 hole, then the golfer may shoot his first or "tee" shot and observe the distance and placement of that shot. As indicated by the third block, the actual ball placement is then spotted on the screen electronically so the player may observe the distance from his lie to the green on the screened hole. The player then plays his second shot, using a wood or an iron depending on the distance of his imaged ball from the imaged green.

Some short holes may require only one or two shots or strokes to reach the green. Longer holes, like that on the screen of FIG. 3 may require three or more strokes to reach the green. Therefore, the third, or "chip" shot has been shown in FIG. 1 as an alternate process step, since it may not be a part of the process on every occasion. After the theoretical green is reached, as indicated by the player controlled image ball on the computer screen, the player may move to the adjacent practice green and putt for the hole. He may then mark his score card with the total number of actual strokes he has used for that hole.

In an alternate method of the invention the player may choose to remain at the tee area of the practice range after reaching the "green" on the first hole and play the tee and approach shots for each succeeding hole before moving to the practice greens for the putting phase of each hole. This method is diagrammatically shown by the broken line blocks of FIG. 1 wherein the computer is programmed for the second and succeeding holes once the ball is on or very near the green. After the eighteen theoretical greens succively indicated on the computer screen are successively reached by the player, he can then move from the range tee area to the practice greens and putt out for each hole and mark his card for each hole.

Figures 2, 4:
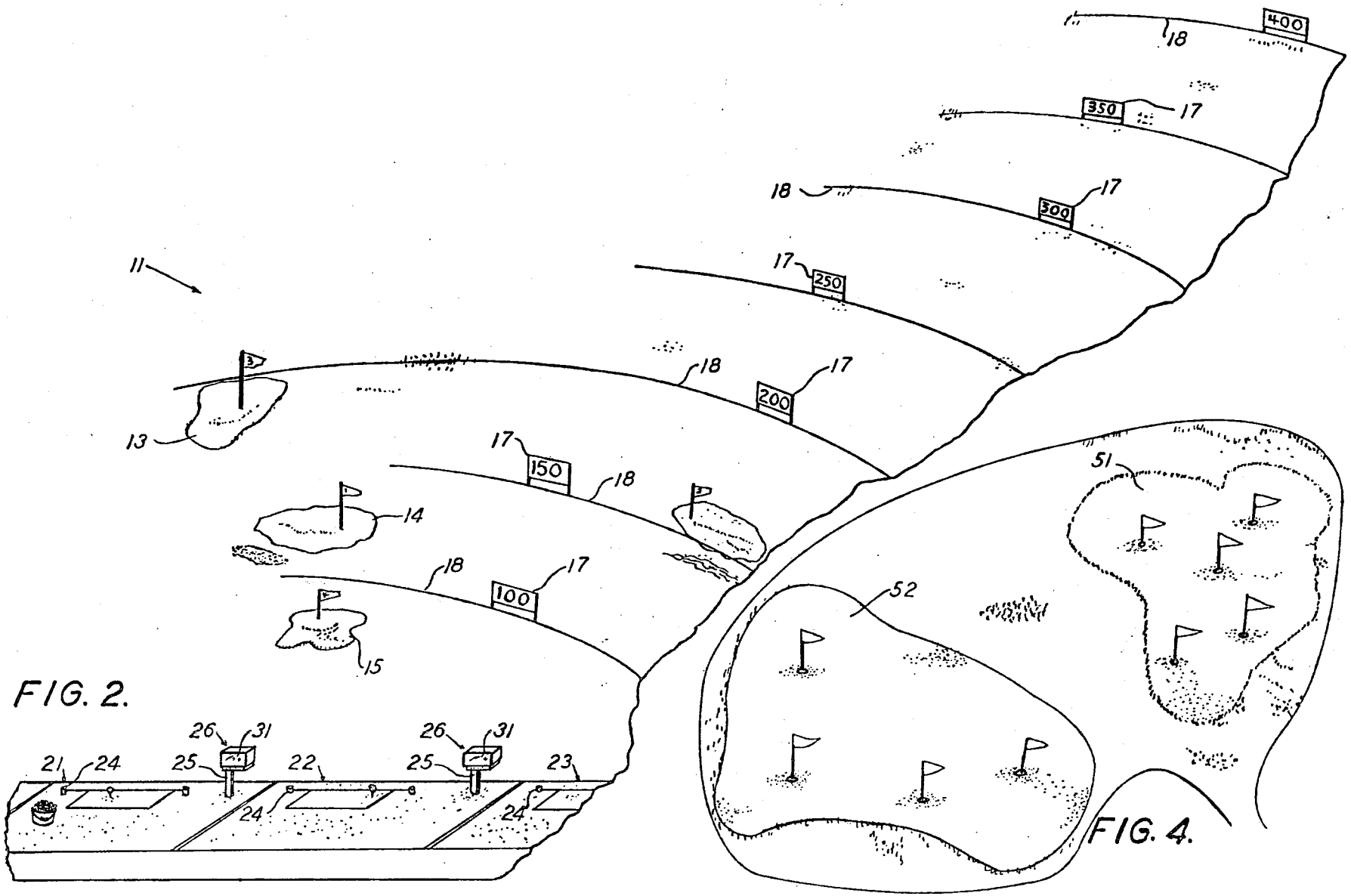
FIG. 2 is a schematic layout of a driving range area in accordance with the invention.
FIG. 4 is a schematic view of a practice putting green layout.

FIGS. 2, 3 and 4 illustrate the apparatus which implements the process of the invention, including the combination of a practice driving range 11 with practice approach greens 13, 14 and 15. The greens are flagged for better perception of their distinctiveness and the range, including the portion occupied by the approach greens, has distance billboards 17 and ground lines 18 at convenient distance increments from the player's tee zones 21, 22 and 23.

Each tee zone has markers 24 and a fixed vertical post 25 to which a computer 26 is releasably secured. As can be best seen in FIG. 3, each computer has a video or viewing screen 31 on which an image diagram of a particular golf course hole appears. In FIG. 3 the image is of a course called "St. Andrews" and of the fourth hole of that course. Pertinent data such as the hole length and the indicated par may show in the diagram, along with the general contour of the hole and its hazard locations. Distance marks such as the broken lines 32, 33 and 34 at convenient ranges from the imaged tee markers 24, enable players accurately to place the ball.

Each computer has ball imaging controls such as the slide bars 36, 37 of FIG. 3 which enable the player to place an image of his struck range ball at the proper place on the screened layout of the hole. To position his ball after the second stroke the player just adds the yardage to his two drives and places the image ball that sum of yards from the imaged tee. Alternatively, the computer may be used to add yardage and indicate remaining distance. The imaged ball indicates whether the player next shoots an approach shot toward one of the approach greens 13, 14 or 15. He chooses the particular green in accordance with the distance indicated by the image ball on the screen, and the actual range distance of a green from his tee zone.

Each computer has, in addition to the ball imaging slide bars, on-off knob 41 and program advance knob 42. Preferably the cassette program is slidable into a recess 44 in the front of the computer 26, like the program cassette 45 residing therein.

Since the computer may accept various programming cassettes, the player's choice of simulated golf courses is limited only by the finite supply of cassettes kept in stock by the proprietors of the golf practice range.

While the practice approach greens of FIG. 2 are shown plainly, the invention does not preclude approach greens that are surrounded by sand traps and mounds, or other hazards which do not interfere with the primary function of the golf practice driving range. Similarly, the practice putting greens shown fragmentarily in FIG. 4 may be patterned after famous greens of the world and so identified. Each green may have several cups with flags so the player may chip to a suitable flag from off the green and then putt out. For instance, green 51 of FIG. 4 may be considered the green for the first through fifth holes of every course programmed, or a player may select the green 52 as more like the particular course he chose to simulate play on, and assign it a sequence number not related to the physical layout of the practice greens.

It is thus apparent that a player may simulate play on any one of many desirable golf courses and test his game with a great deal of verity without travel or great expense. Such choice adds variety to golf practice at little added cost and sharpens skills in a measurable way.

While the invention has been illustrated specifically in the foregoing specification and drawing, the modifications set forth do not exhaust the scope of the invention. Other modifications within its scope may occur to those skilled in this particular art. It is therefore desired that the invention be measured by the attached claims rather than by the purely illustrative disclosure set forth above.

I claim:

1. A game process employing a conventional golf practice range with driving range, approach greens, practice putting greens, a computer having a read-out screen programmable with a golf course hole layout and player accessible controls for indicating the playing ball position on said hole layout on said screen, the steps including programming said computer to image successively the hole layout for each hole of a given golf course, driving a ball on the driving range, positioning an image ball on said screen image hole layout in accordance with the position on the driving range of the driven ball, stroking successive balls on said driving range, positioning said image ball on said screen layout in accordance with the accumulated distance from stroking of the first and successive balls, stroking another ball on said putting practice green after said image ball indicates location on said imaged green until said ball is downed in said green cup, and repeating the steps of the process for each screened hole layout with which the computer is programmed.

2. A process in accordance with claim 1 wherein one of said successive balls is struck after said first ball toward an approach green on said driving range, said green being selected in accordance with the distance from said green and the player approximating the scale distance from the image ball to the green on the computer screen hole layout.

3. A game process employing a conventional golf practice range with a driving range, approach greens and practice putting greens; a computer having a read-out screen programmable with one or more golf course hole layouts and having player accessible controls for indicating a played ball position on said hole layout on said screen and a computer programming unit; the steps of programming said computer with said programming unit to image successively the hole layout for each hole of a given golf course, then for each hole programmed performing the steps of driving a ball on the practice driving range, positioning an image ball on said computer screen image hole layout in accordance with the position on the driving range of the driven ball, stroking successive balls on said driving range, positioning said image ball on said screen layout in accordance with the accumulated distance from the plays of the first and successive struck balls, striking one of said successive balls toward an approach green on said driving range, said selected approach green being spaced from said player in accordance with the indication of the screen hole layout and the advanced ball image thereon, and stroking another ball on said putting practice green after said image ball indicates ball location on said imaged green until said ball is downed in said green's cup.

* * * * *